United States Patent [19]

Droessler et al.

[11] Patent Number: 4,866,454

[45] Date of Patent: Sep. 12, 1989

[54] MULTI-SPECTRAL IMAGING SYSTEM

[76] Inventors: Justin G. Droessler, 8141 River View Ter., Fridley, Minn. 55432; George J. Gill, 220 Ash St., Waltham, Mass. 02154

[21] Appl. No.: 21,858

[22] Filed: Mar. 4, 1987

[51] Int. Cl.[4] ..... H01Q 19/13

[52] U.S. Cl. ..... 343/725; 343/781 CA; 342/53

[58] Field of Search ..... 343/725, 781 R, 781 P, 343/781 CA, 835, 837; 342/53

[56] References Cited

U.S. PATENT DOCUMENTS

| | | | |
|---|---|---|---|
| 3,114,149 | 12/1963 | Jessen, Jr. | 343/720 |
| 3,165,749 | 1/1965 | Cushner | 343/911 |
| 3,389,394 | 6/1968 | Lewis | 343/725 |
| 3,696,432 | 10/1972 | Anderson et al. | 343/725 |
| 3,713,156 | 1/1973 | Pothier | 342/53 |
| 3,914,768 | 10/1975 | Ohm | 343/779 |
| 3,995,275 | 11/1976 | Betsudan et al. | 343/781 CA |
| 4,092,648 | 5/1978 | Fletcher et al. | 343/781 CA |
| 4,282,527 | 8/1981 | Winderman et al. | 343/725 |
| 4,312,002 | 1/1982 | Stewart | 343/725 |
| 4,355,313 | 10/1982 | Hubert | 343/725 |
| 4,477,814 | 10/1984 | Brumbaugh et al. | 343/725 |
| 4,489,331 | 12/1984 | Salvat et al. | 343/753 |
| 4,636,797 | 1/1987 | Saffold et al. | 343/725 |
| 4,698,638 | 10/1987 | Branigan et al. | 343/725 |
| 4,701,765 | 10/1987 | Arduini et al. | 343/781 CA |

*Primary Examiner*—Rolf Hille
*Assistant Examiner*—Michael C. Wimer
*Attorney, Agent, or Firm*—John G. Shudy, Jr.

[57] ABSTRACT

A multi-spectral imaging apparatus with a common collecting aperture, which combines a high performance infrared imaging system with a high performance millimeter wave transceiving system. Two mirror surfaces are combined with a refractive corrector in the infrared mode and with a single reflective parabolic antenna in the millimeter wave mode. The dual mode system functions well in a scanning as well as a staring configuration.

9 Claims, 2 Drawing Sheets

MULTI-SPECTRAL IMAGING SYSTEM

BACKGROUND OF THE INVENTION

The invention generally relates to radiation sensing systems. The present invention particularly pertains to multi-spectral antenna systems and more particularly a system combining detection of infrared radiation with that of radio frequency detection and transmission.

Prior art contains multi-spectral detection and transmission systems having common collector elements and apertures for detecting both radio frequency radiation and electro-optical radiation, and for transmitting radio frequency radiation.

SUMMARY OF THE INVENTION

The present invention combines a high performance infrared (IR) imaging system with a high performance millimeter wave (MMW) transceiving system.

One advantage of this invention over the prior art is that the IR portion of the dual mod system has a focal plane with high quality imagery over a full 4° field of view. Further, the field of view of the IR mode identically matches the beam size of the MMW. The dual mode system works well in a scanning as well as a staring configuration. The performance of the IR system and the MMW system can be optimized separately.

DESCRIPTION OF THE PREFERRED EMBODIMENT

Figure 1:
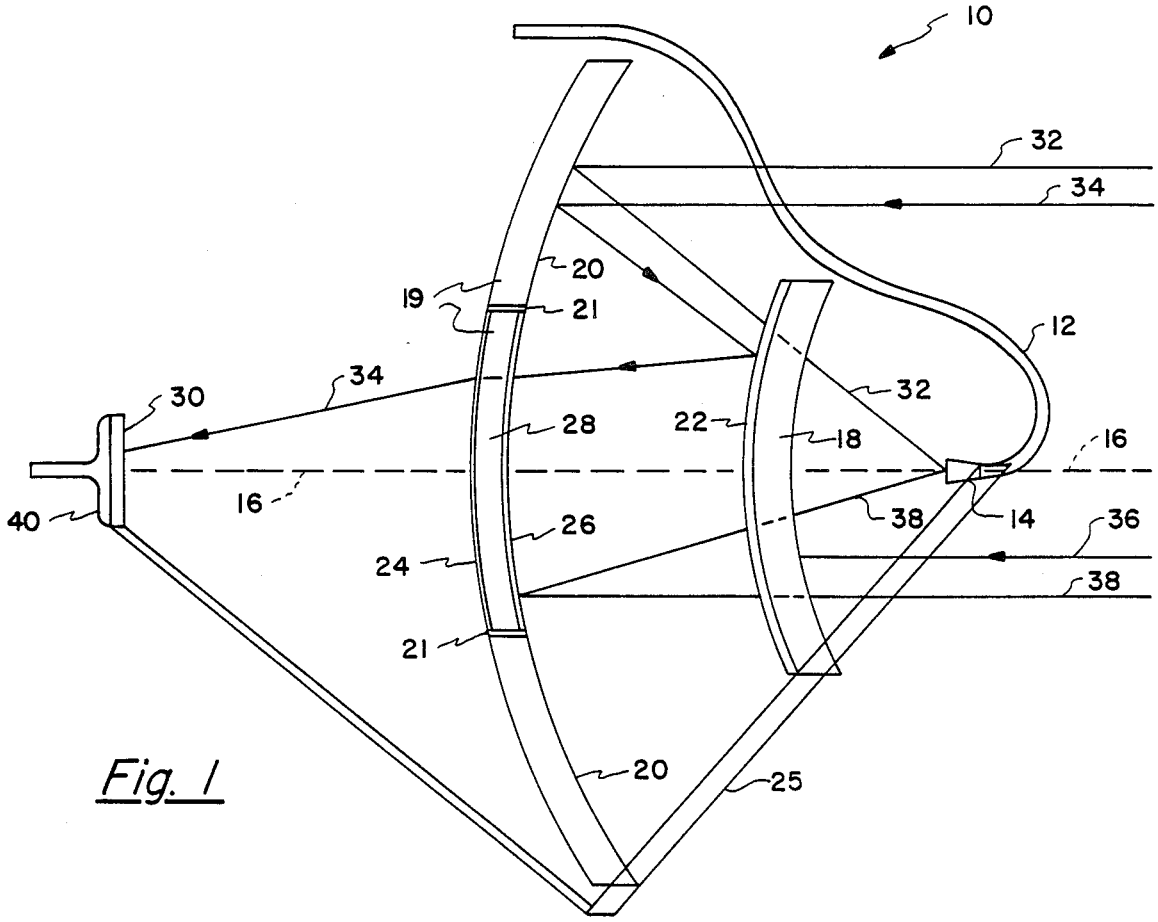
FIG. 1 is a top view of the invention.

FIG. 1 shows a device and function of the present invention. The antenna is designed to receive IR signals 34 and MMW signals 32 and 38. Also, the device is designed to transmit MMW signals 32 and 38.

IR signals 34 impinge the outer section 20 of the primary reflector 19, are reflected towards secondary reflector 18, impinge upon thin film 22 and are reflected back towards the center section or core 28 of the primary reflector 19. IR signals 34 impinge a thin film 26, go through core 28, through another thin film 24, and impinge upon focal plane 30. IR waves 34 are focused by core 28 prior to impingement on focal plane 30. Attached to focal plane 30 is IR sensor 40 which is composed of an array of individual photodetectors sensitive to infrared radiation. Each pixel in the detector array 40 has, for example, a 0.4 milliradian resolution. The IR image focused upon focal plane 30 is converted into electrical signals by sensor 40. The signals from detector 40 may be processed and/or compared with signals from the MMW radiation for purposes as desired.

In receiving MMW signals, one path such signals may follow is that of 32. MMW signals 32 impinge upon the outer section 20 of the primary reflector 19 and are reflected back towards the secondary reflector 18. MMW signals 32 go through thin film 22 and through secondary reflector 18 to a feedhorn 14 as supported by structure 25. MMW signals may follow the path of 38 also, among other paths. MMW signals 38 go through secondary reflector 18 and thin film 22 and impinge upon the film 26 of the center or core section 28 of the primary reflector 19. MMW signals 38 are reflected back through thin film 22 and secondary reflector 18 onto the feedhorn 14. The MMW signals 32 and 38 received at feedhorn 14 are fed through the waveguide 12 and are directed onto appropriate receiver instrumentation.

Device 10 may also transmit MMW signals in the same direction that it receives such signals. For instance, a signal may come from transmitter instrumentation through waveguide 12 to the feedhorn 14. The emitted MMW signals may follow the path of 32 passing through secondary reflector 18 and thin film 22, impinging upon the outer section 20 of the primary reflector 19 and being reflected again, out in the direction which MMW signals are received, i.e., along path 32. Also, the emission of MMW signals may pass through secondary reflector 18 twice. MMW signals, following path 38 from feedhorn 14, pass through secondary reflector 18 and thin film 22, impinge upon thin film 26 of the center or core section 28, and are reflected back from section 28 at the point of thin film 26 on through thin film 22 and secondary reflector 18 in the same direction that MMW signals are received.

Figure 2:
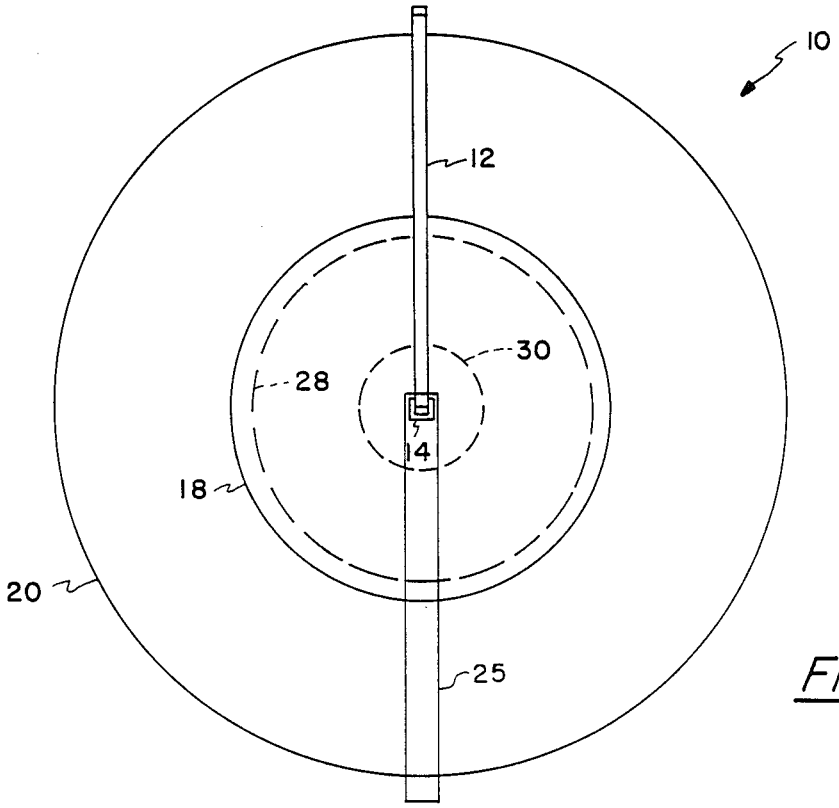
FIG. 2 is a front view of the invention.

FIG. 2 shows the device 10 from the direction having feedhorn 14 nearest to the observer. All of the components illustrated in FIG. 2 are illustrated with the same identification numbers in FIG. 1.

Device 10 has an arrangement of components and properties peculiarly unique to the invention. Coating 22 of the secondary reflector 18 is a dichroic surface which reflects the IR signals and passes the MMW signals. The thin film coating 26 on the center section 28 of the primary reflector 19 is a dichroic surface which passes the IR signals and reflects the MMW signals. The coatings 22 and 26 may be provided by Optical and Conductive Coatings which is a company located in Pacheco, Calif. The dichroic coating or thin film 26 has an approximate transmittance of 85% in the IR range. For MMW signal considerations there is an approximate comparable reflectivity of 85% to maintain the maximum gain degradation of 1 db.

Secondary reflector 18 has a dichroic surface or coating 22 which reflects IR signals and allows MMW signals to pass undistorted. Because MMW signals may pass through reflector 18 twice, care must be taken that the insertion phase on the first pass does not cause a phase error in the plane wave that is incident on the main reflector 19. Phase distortions can be minimized by selecting the thickness of the material for reflector 18 to be such that the total insertion phase is an integral number of wavelengths greater than the equivalent air space which it has displaced. The formula for determining this thickness t is:

$$t = N * (\lambda_0/(\sqrt{\epsilon_r} - 1))$$

where N is an integer, $\epsilon_r$ is the dielectric constant, $\lambda_o$ is the free space wavelength. This formula assumes normal incidence for the first pass of the MMW signal through coating 22 and reflector 18. This is an appropriate assumption for a first order approximation since the curvature of reflector 18 is gradual.

In this particular embodiment, the MMW frequency is in the 94 GHz range. The dichroic film 22 is on the order of 10–25 microns which is a neglible thickness in this MMW range. This layer is some form of alumina in layers on the quartz supporting material of the aspheric substrate of secondary reflector 18. Both the layers and substrate of reflector 18 are low loss in the MMW range.

Another concern with the secondary reflector 18 is the reflection of the MMW signals from its surfaces. This effect can be minimized by making the thickness of reflector 18 an integral number of half wavelengths as given by the following:

$$t = (N * \lambda_0)/(2 * \sqrt{\epsilon_r})$$

The total phase delay in the material is required to be an integral number of half wavelengths so that the reflections from each surface will cancel each other. With quartz as the supporting material, both of the above conditions are uniquely satisfied. For dielectric constant $\epsilon_r = 3.8$, the thickness of reflector 18 is 0.263 inch . Adjusting for the alumina layer of coating 22, the quartz thickness is 0.261 inch.

Figure 3:
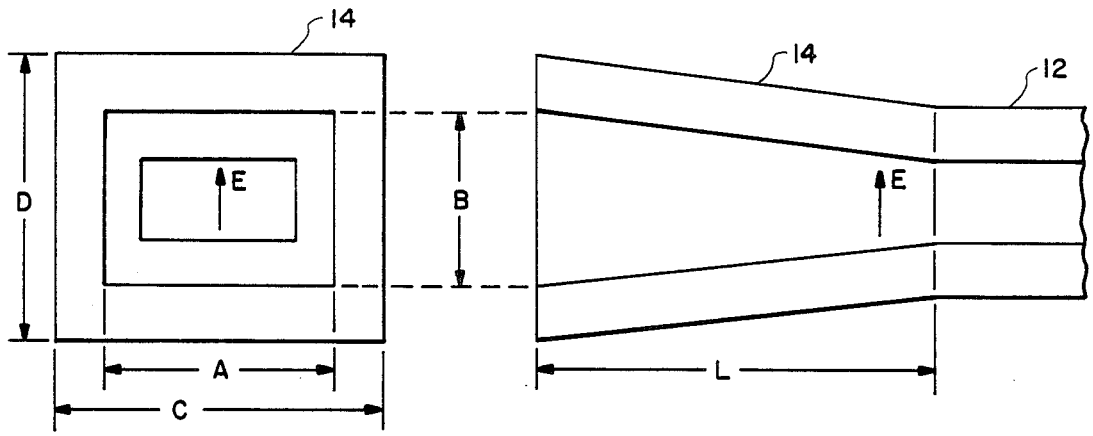
FIG. 3 shows the feedhorn of the invention.

Optimal dimensions for the feedhorn are noted. The focal length/diameter (f/d) ratio of the main reflector is specified to be 0.55 corresponding to a full angle subtended at the feed of 97° which yields the following dimensions of feedhorn 14 was illustrated in FIG. 3: A=0.150 inch, B=0.110 inch, C=0.230 inch, D=0.190 inch, and and L=0.250 inch, where A is the inside dimension in the H plane, B is the inside dimension in the E plane and L is the axial length of the horn flare. C and D are the outside dimensions of feedhorn 14.

The waveguide 12 and feedhorn 14 should be formed from coin silver. The horn 14 faces the concave side of secondary reflector 18 and is centered on the optical axis 16 of the primary and secondary reflectors. The overall blockage is minimized since the secondary reflector is a resonant, transparent window at 94 GHz.

With the primary reflector diameter of 5.3 inches and the f/d ratio of 0.55, the overall depth of the antenna should be approximately 3.5 inches. The surface material of the primary reflector 20 may be any good conductive metal such as gold, copper or silver. The surface quality of the primary reflector 20 required for the IR signals is more than sufficient for the MMW signals.

Based on the 5.3 inch effective aperture diameter and the 0.55 f/d ratio, the following predicted performance values, supported by tests, are: frequency at 94 GHz; gain at 37 dBi; beam width at 1.8°; side lobes at −16.5 dB; VSWR at 1.5; and a pattern integrity having a uniform beam and side lobes.

The secondary reflector 18 must be supported relative to the primary reflector 20 such that the foci of both reflectors are coincident and coaxially aligned, and supported by structure 25. This is standard practice in both optical and microwave Cassegrain design considerations. The center section or plug 28 of the main reflector 19 must be a continuation of the outer section 20 so that the total surface conforms to a paraboloid of the intended f/d ratio to within 0.001 inches RMS or better.

Each of the dichroic reflectors, 22 and 26, should be separately tested at both IR and MMW operating frequency bands to insure that their transmittance and reflectance values are within the prescribed ranges of 85% or better.

The secondary reflector 18 must satisfy several considerations. First, it must provide a zero relative path length to the central portion of the incident 94 GHz radiation. Second, it must provide a good impedence match at 94 GHz so that reflections of the incoming signals between the air/quartz interface are minimized. The above-determined thickness of 0.261 inch is the best compromise to optimize all of the 94 GHz requirements.

The incident 94 GHz signals pass through the curved secondary lens 18 at small angles (approximately from 1° to 20°). Because of the curvature and the varying incident angle, the energy will be spread out resulting in a small redistribution of an amplitude and phase of the incident energy. The 94 GHz wavefront which is reflected by the primary reflector 19 back to the waveguide feed 14, again passes through the secondary lens 18. In this case, the complete wavefront passes through lens 18 so there is only a small amount of phase distortion to the wave due to the varying incident angle. The effect of this is to refocus the outermost rays by approximately 0.05 inch away from the reflector 19. This is similar to the distributive focus of a spherical reflector but in the opposite direction which would partly compensate for the spherical aberrations. The exact position of the focus is not crucial since the feedhorn 14 position will be made adjustable for optimizing the 94 GHz performance as described below.

The profile of the secondary surface 22 facing the outer section 20 of primary reflector 19 is determined for optimum performance as a secondary reflector 18 in the Cassegrain system for the IR mode. The back surface of the secondary reflector 18 should have a radius equal to that of the front surface less the above-specified 0.261 inch thickness which results in both external surfaces having the same center of curvature. A variation in the thickness across the secondary lens 18 was considered to reduce the "spreading" of the incoming wave. However, the correction was determined to be only 0.003 inch at the edges which is negligible. The finish for both surfaces should be 16 micro-inches or better for the 94 GHz operation. The polished optical quality surface is more than sufficient for this application.

There are concerns about the primary reflector 19 from a MMW perspective. The aspherical reflector has a departure of about 0.01 inch from a parabolic curve. The support ring 21 for the center section 28 of the primary reflector 19 is raised above the reflective surface 20. The exact curvature for the primary reflector 19 has been compared with the equivalent parabolic curves. As the focal length is increased the differential between these curves is reduced at the edge and moves inward. In practice, the feedhorn 14 can be designed to be adjusted along the focal axis 16 to reduce error.

The supporting ring 21 in the center of reflector 19 should be machined to conform to the parabolic reflector surface 20 and 26 and should be one-half wavelength thick 0.062 inch) to minimize the degradation in the 94 GHz performance. The center section 28 makes a continuous curve with the outer section 20 of the primary reflector 19.

The primary reflector center section or plug 28 has a thickness of about 0.2 inch and an index of refraction of 4. Center section 28 is composed of a germanium aspheric substrate with dichroic thin film coatings 24 and 26. The surface curvature of the outer section 20 and inner section 28 of the primary reflector 19 is a near parabolic curve of a conic constant of −1.31107. The material of the outer section 20 of the primary reflector 19 may be aluminum or other appropriate material and its thickness is to meet the minimum requirements for structural stability of the reflector. The conic constant of center section 28 surface 24 is −2.56501. The germanium substrate of the center section 28 functions as a lens for focusing the IR light onto focal plane 30.

The conic constant of surface 22 on the secondary reflector 18 is −4.06866. The surface of the secondary reflector 18 facing the feedhorn is not critical and may be similar to the conic constant of surface 22. IR radiation following the path 36 impinging upon the secondary reflector 18 is of little effect or use since it is effectively lost IR energy. This secondary IR obscuration amounts to 23% of the collecting aperture The IR system is an f/1.5 system with a focal length of 8 inches. Its performance over a full field of view of 4° is 0.5 miliradian blur sizes for 80% of the energy over the wavelength band of 3 to 5 microns.

We claim:

1. A multi-spectral imaging system comprising:

first means, mounted to a supporting structure, for reflecting millimeter wave (MMW) radiation and infrared (IR) radiation, wherein said first means is a curved reflector having a peripheral solid section that is reflective to MMW and IR radiation and having a center solid core section, flush with and following the curvature of the peripheral section, that is reflective to MMW radiation and transparent to IR radiation;

second means, mounted to the supporting structure, for reflecting IR radiation and conveying MMW radiation, wherein said second means is a solid curved element coaxially aligned with said first means;

third means, mounted to the supporting structure, for emitting and receiving MMW radiation, wherein said third means is a horn facing said first and second means, and is coaxially aligned with said first and second means, and said second means is positioned between said first and third means at a MMW radiation focus point of said first means; and detecting means, mounted to the supporting structure, for detecting IR radiation coming through the center section of said first means, and said detecting means positioned at an IR radiation focus point of the core section of said first means, and said first means is positioned between the IR radiation focus point and said second means.

2. Apparatus of claim 1 wherein:

MMW radiation emitted by said third means goes through said second means and is reflected by said first means to a target from which some of the MMW radiation is reflected by the target toward said system and is reflected by said first means to said third means for reception; and IR radiation emitted by the target towards said system is reflected by the peripheral section of said first means to said second means which in turn reflects the IR radiation through the center section of said first means onto said detecting means.

3. Apparatus of claim 2 wherein:

said first and second means have focal centers having a common optical axis perpendicular to central surfaces of said first and second means;

said third means is positioned at a focus point of said first means and has a focal center on said common optical axis, and central portions of emitted and received radiation are parallel to said common optical axis; and said detecting means has a focal plane centered on and perpendicular to said common optical axis.

4. Apparatus of claim 3 wherein:

the center section of said first means comprises a germanium aspheric substrate having dichroic thin, smooth and continuous film coating; and said second means comprises a quartz aspheric substrate having a dichroic thin, smooth and continuous film coating.

5. Apparatus of claim 4 wherein:

said first means has a concave surface facing said second and third means; and said second means has a convex surface facing said first means.

6. Apparatus of claim 5 wherein:

the concave surface of said first means, including the peripheral and core sections, is a paraboloid surface; and the center section of said first means is an IR radiation lens for focusing conveyed IR radiation onto said detecting means.

7. Apparatus of claim 6 wherein:

a thickness of the dichroic film coating on said second means is determined by $$N(\lambda_0/(\sqrt{\epsilon_r} - 1))$$

wherein N is an integer, $\epsilon_r$ is the dielectric constant and $\lambda_o$ is the free space wavelength, resulting in a thickness of about 10–25 microns in a form of alumia on the quartz supporting material of said second means; and a thickness of said second means is an integral number of half wavelengths as determined by $$N\lambda_0/2\sqrt{\epsilon_r}.$$

8. Apparatus of claim 7 wherein a focal length/diameter ratio is approximately 0.55.

9. Apparatus of claim 8 wherein said detector means comprises an array of individual photodetectors sensitive to IR radiation.

* * * * *